US008657697B2

(12) United States Patent
Brown et al.

(10) Patent No.: US 8,657,697 B2
(45) Date of Patent: Feb. 25, 2014

(54) PLAY SYSTEM ACCESSORY WITH MOTION-ACTIVATED SOUND MODULE

(75) Inventors: Patrick W. Brown, Auburn, OH (US); John R. Nottingham, Bratenahl, OH (US); John W. Spirk, Gates Mills, OH (US); Robert F. Soreo, Cleveland Heights, OH (US); Randall Lee Day, Lamar, MO (US); Daniel Ray Whyman, Lamar, MO (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 255 days.

(21) Appl. No.: 13/076,273

(22) Filed: Mar. 30, 2011

(65) Prior Publication Data

US 2011/0244973 A1 Oct. 6, 2011

Related U.S. Application Data

(60) Provisional application No. 61/318,989, filed on Mar. 30, 2010, provisional application No. 61/319,076, filed on Mar. 30, 2010.

(51) Int. Cl.
*A63G 9/12* (2006.01)
*A63G 9/00* (2006.01)

(52) U.S. Cl.
USPC ..... 472/118; 472/64; 446/175

(58) Field of Classification Search
USPC ..... 472/118–125, 59–61, 43, 130, 64; 446/219, 298, 397, 175, 438
See application file for complete search history.

(56) References Cited

U.S. PATENT DOCUMENTS

| | | | | |
|---|---|---|---|---|
| 5,861,808 | A * | 1/1999 | Lehmann et al. | 340/571 |
| 6,416,381 | B1 * | 7/2002 | Walter et al. | 446/397 |
| 7,074,106 | B1 * | 7/2006 | Deutsch et al. | 446/175 |
| 7,637,556 | B2 * | 12/2009 | Haber | 296/146.8 |
| 8,047,925 | B2 * | 11/2011 | Burgaard et al. | 472/118 |
| 2009/0105001 | A1 | 4/2009 | Burgaard et al. | |
| 2009/0131185 | A1 | 5/2009 | Speedie | |

FOREIGN PATENT DOCUMENTS

| | | | |
|---|---|---|---|
| JP | 06218136 | A | 9/1994 |
| WO | 9505222 | A1 | 2/1995 |

OTHER PUBLICATIONS

PCT Search Report and Written Opinion from PCT Application No. PCT/US2011/030595 entitled Play System Accessory With Motion-Activated Sound (Dated Dec. 9, 2011).

* cited by examiner

*Primary Examiner* — Kien Nguyen
(74) *Attorney, Agent, or Firm* — Hovey Williams LLP

(57) ABSTRACT

An accessory for a play system comprises a support configured to be suspended from or supported on the play system; and a sound module coupled with the support. The sound module comprises a motion detector for detecting motion of the support and a sound-emitting device for emitting sounds in response to motion of the support as detected by the motion detector.

16 Claims, 11 Drawing Sheets

PLAY SYSTEM ACCESSORY WITH MOTION-ACTIVATED SOUND MODULE

RELATED APPLICATIONS

The present application claims the priority benefit of U.S. Provisional Patent Application Ser. No. 61/318,989 entitled "TUNNEL WITH SOUND," filed Mar. 30, 2010 and U.S. Provisional Patent Application Ser. No. 61/319,076 entitled "SWING WITH SOUND," filed Mar. 30, 2010, the entire disclosures of which are incorporated herein by reference.

BACKGROUND

Swing sets and other play systems typically include a frame or other support structure and a number of play accessories such as slides, climbing walls, swings, etc. supported on or suspended from the support structure. Many of the play accessories move from side-to-side, forward and backward, and/or up and down under the influence of children playing on or in the accessories.

SUMMARY

Applicant has discovered that children's enjoyment of moveable play accessories is enhanced when they receive sensory feedback of the movement. Embodiments of the present invention take advantage of this discovery by providing a play system accessory that makes sounds when in motion.

An embodiment of the present invention is an accessory for a play system that broadly comprises a support and a sound module coupled with the support. The support is configured for supporting one or more children while playing on the play system and is configured to be suspended from or supported on the play structure in such a way that it can swing, bounce, or otherwise move in a variety of different directions under the influence of children playing in or on it. For example, the support may be a tube, a tunnel, or a swing seat configured to be suspended from the play structure by chains, springs, ropes or other devices.

The sound module is coupled with the support and broadly comprises a motion detector for detecting motion of the support and a speaker or other sound-emitting device for emitting sounds in response to the motion as detected by the motion detector. In one embodiment, the motion detector comprises a ball-switch that simply detects motion or movement of the support. In other embodiments, the motion detector comprises components for detecting the magnitude or direction of motion of the support. For example, an embodiment of the motion detector may comprise several accelerometers or other components for detecting up and down motions of the support, left and right motions of the support, and forward and backward motions of the support.

An embodiment of the sound module may also comprise a processor or other control device for receiving signals from the motion detector and controlling the sounds emitted by the sound-emitting device in accordance with the signals. The control device may vary the type, volume, duration, frequency, or other characteristic of the sound based on a magnitude of motion or direction of motion of the support as detected by the motion detector. For example, the sound-emitting device may emit one sound when children swing or otherwise move the support to the left, another sound when the support is moved to the right, another sound when the support is moved forward, another sound when the support is moved backward, another sound when the support is moved upward, and yet another sound when the support is moved downward. The volume and/or frequencies of sounds emitted by the sound-emitting device may also vary as a function of the movement of the support. For example, the volume of the sounds may increase as the support is moved rapidly and decrease as the support is moved more slowly.

An embodiment of the sound module may also comprise an input for receiving audio signals from an MP3 player or other external audio source for reproduction by the sound-emitting device. The sound module may further comprise memory for storing a plurality of audio files and a selector switch for permitting a user to select which of the audio files is reproduced by the sound-emitting device.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
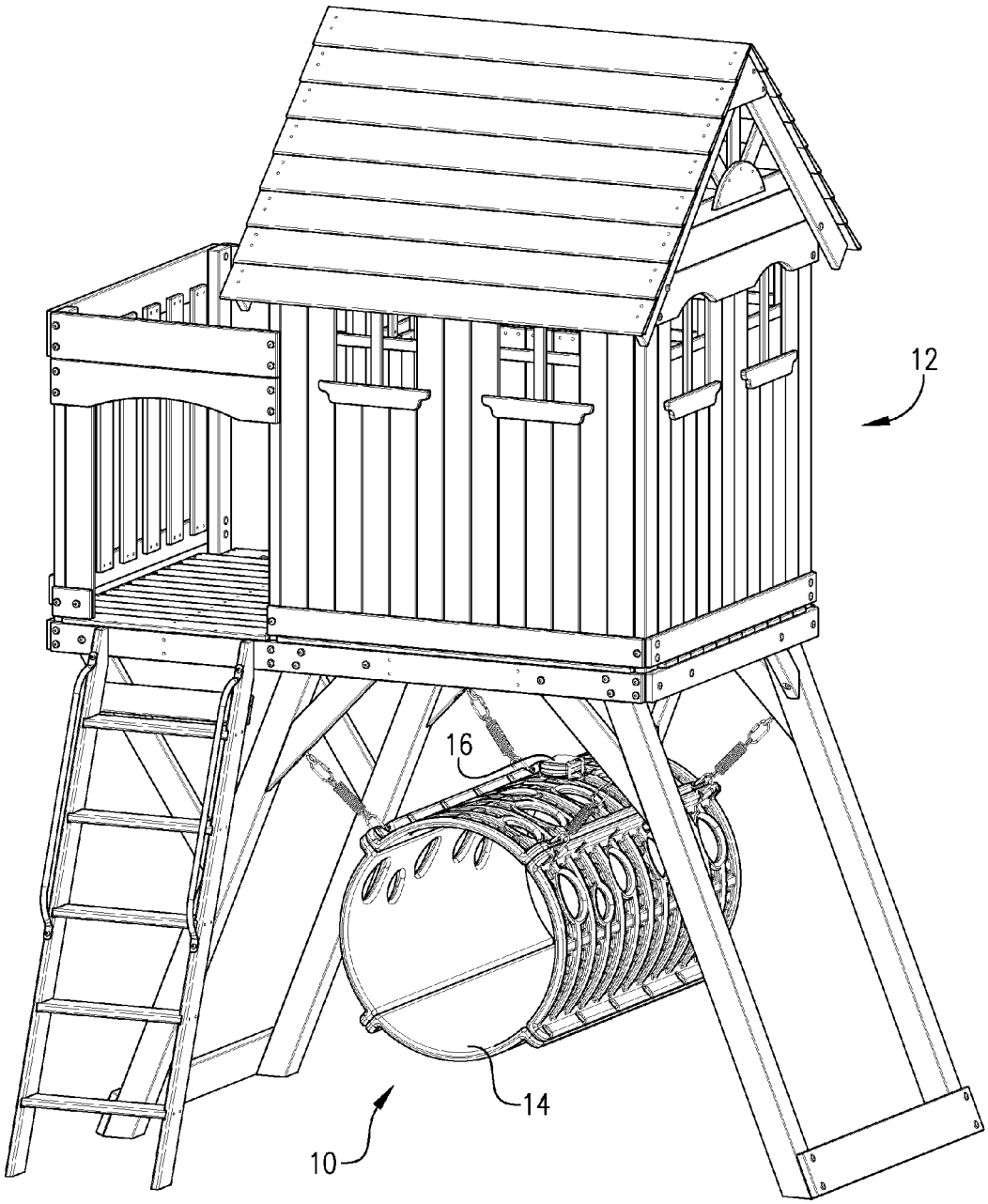
FIG. 1 is a perspective view of a play system accessory constructed in accordance with an embodiment of the invention and shown suspended from an exemplary play system.
Figure 2:
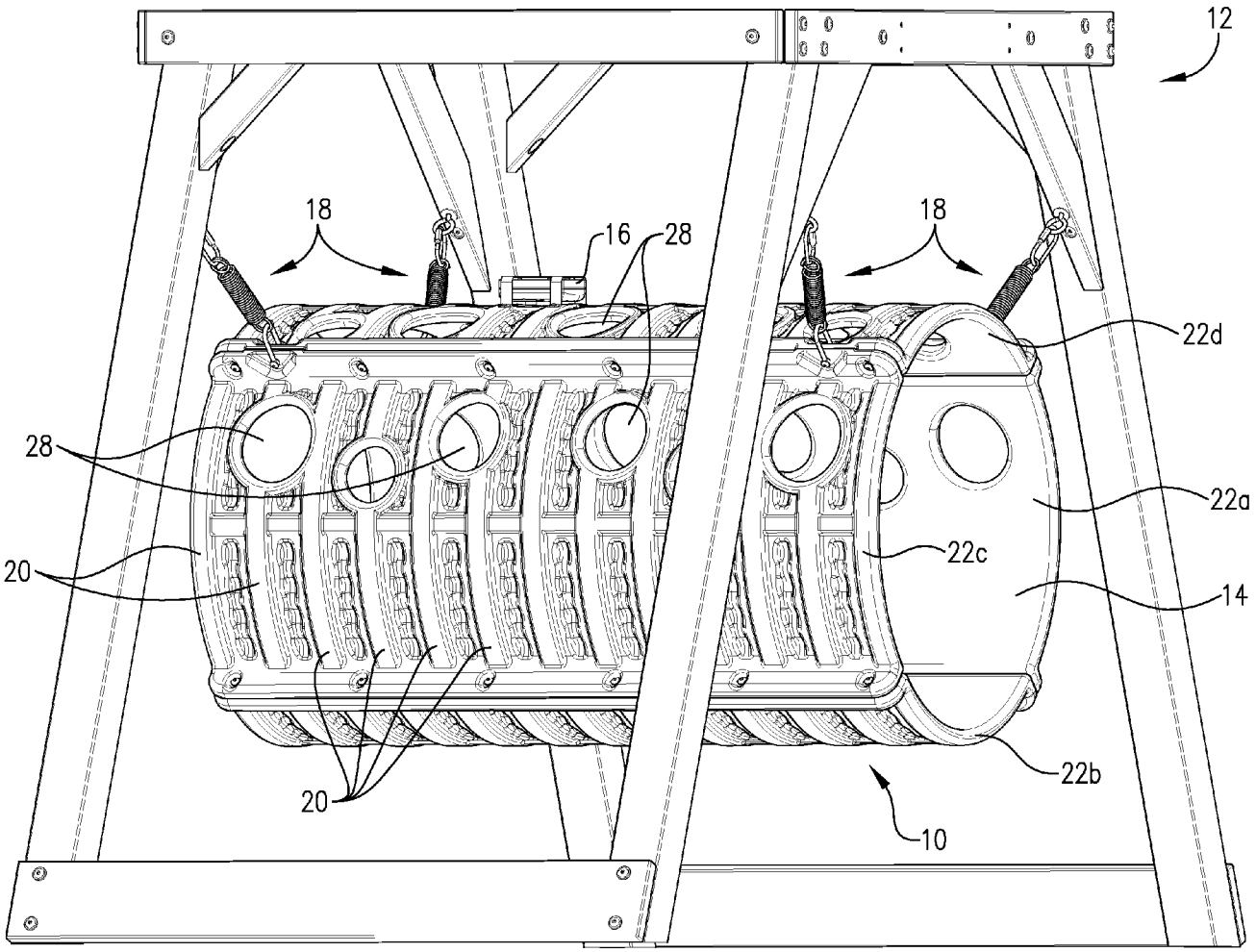
FIG. 2 is an enlarged perspective view of the play system accessory and portions of the play system.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, and particularly FIG. 1, a play system accessory 10 constructed in accordance with an embodiment of the invention is illustrated. The accessory 10 may be suspended from and/or attached to the frame or other support structure of a play system 12 and broadly comprises a support 14 and a sound module 16 coupled with the support. Any number of play system accessories 10 may be suspended from and/or attached to the play system 12, but only one is illustrated and described herein for clarity.

The support 14 can be any device or object capable of supporting children and is configured to be suspended from or supported on the play structure in such a way that it can swing, bounce, or otherwise move to a variety of different positions under the influence of children playing in or on it.

Figure 3:
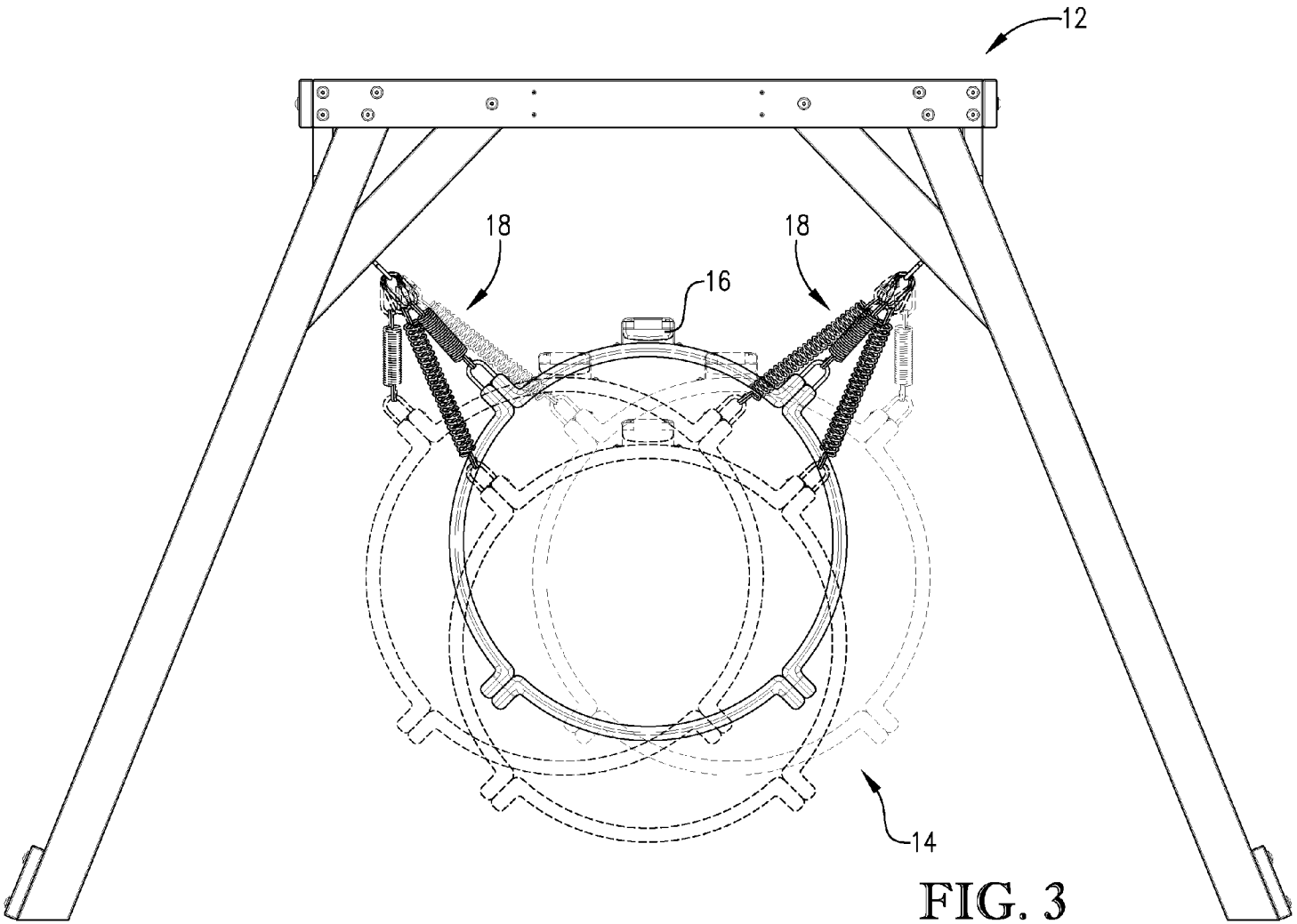
FIG. 3 is a front elevational view depicting various different positions of the play system accessory as it is moved under the influence of one or more children.
Figure 4:
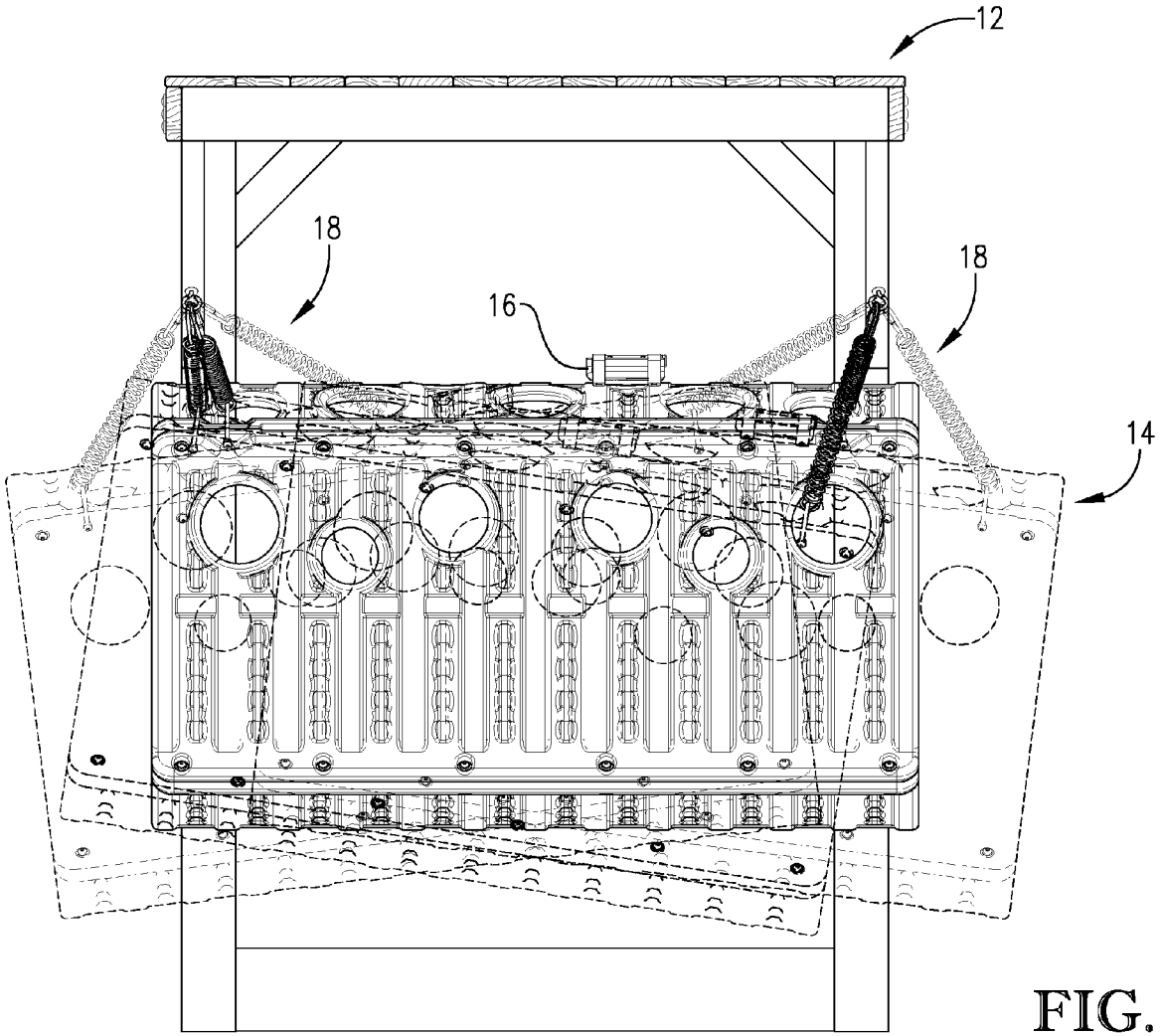
FIG. 4 is a side elevational view depicting various different positions of the play system accessory as it is moved under the influence of one or more children.

One embodiment of the support 14 is illustrated in FIGS. 2-7 and comprises a rigid cylindrical tube or tunnel sized to allow children to climb through it and/or sit within it. The tube is suspended from the play system by a plurality of spring assemblies 18 that permit the tube to bounce and move in a variety of different directions as depicted in FIGS. 3 and 4. The spring assemblies may be attached to the play system and support by hooks, hangers, eyelets, or other fasteners and have built-in travel limits to ensure that the tube doesn't hang too low when multiple children are in it and to limit motion of the tube so that it doesn't strike the play system support structure.

Figure 5:
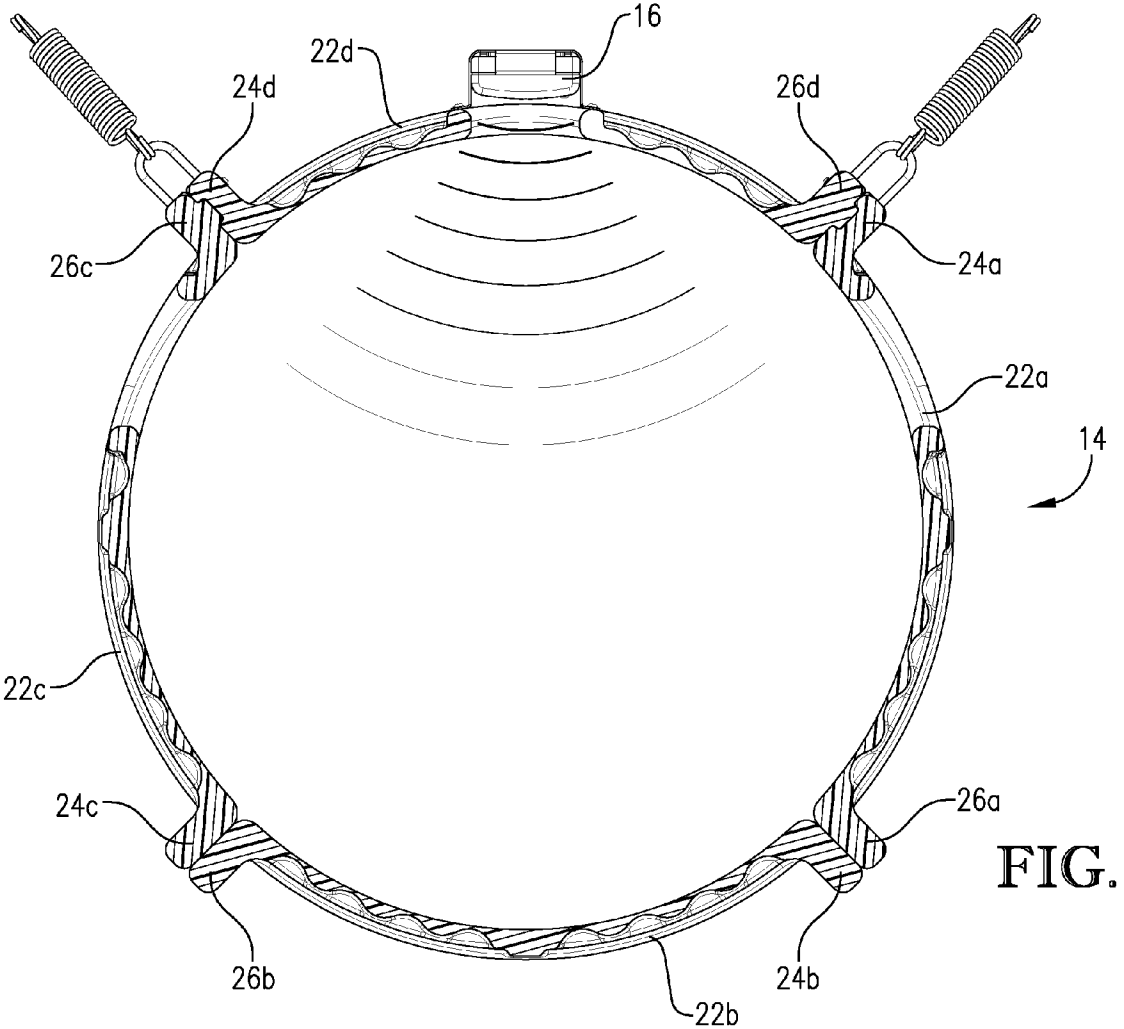
FIG. 5 is a vertical sectional view of the play system accessory depicting sounds emanating from the sound module.
Figure 6:
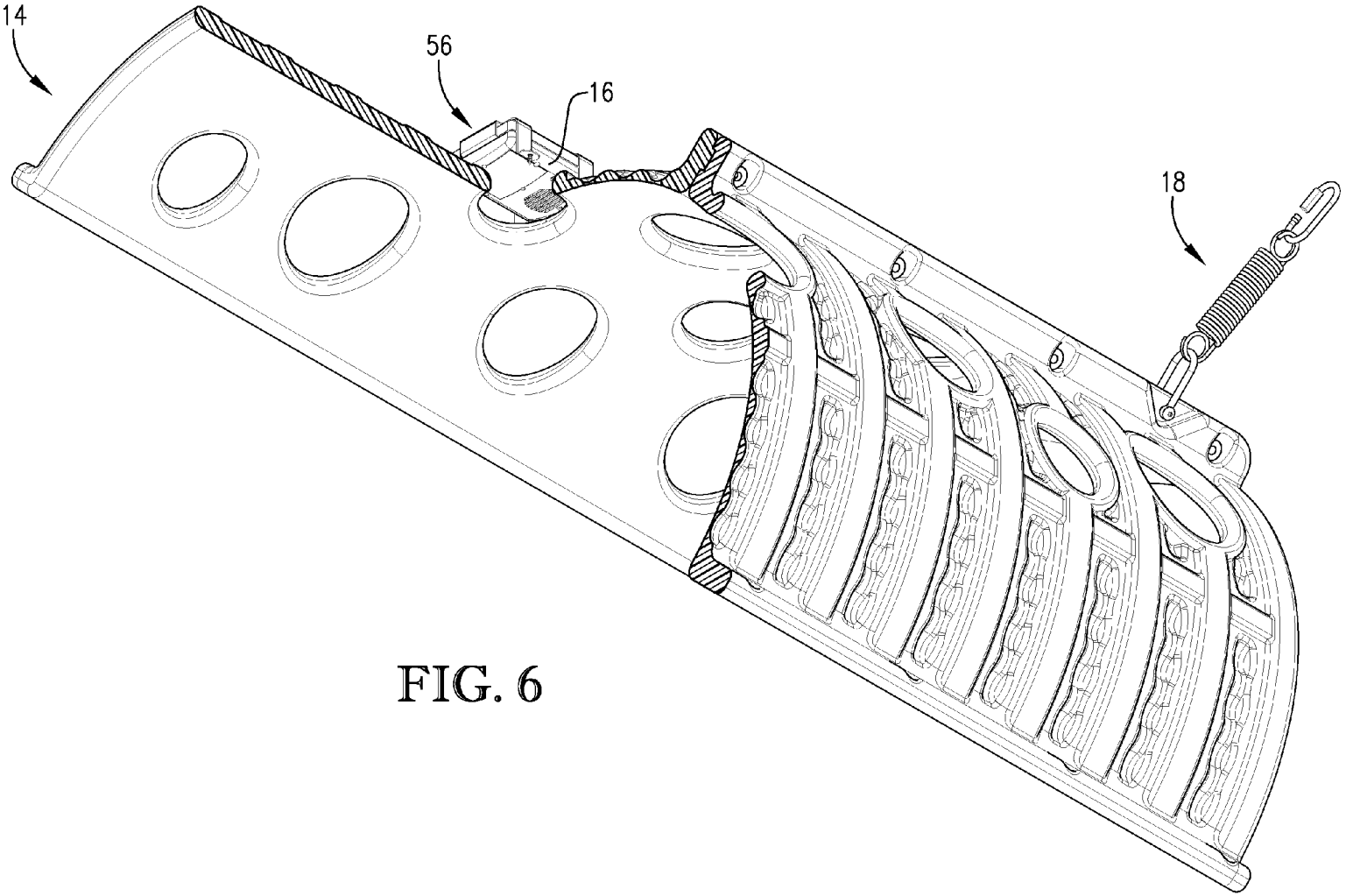
FIG. 6 is a fragmentary partial vertical sectional view of the play system accessory depicting an exemplary attachment location for the sound module.
Figure 7:
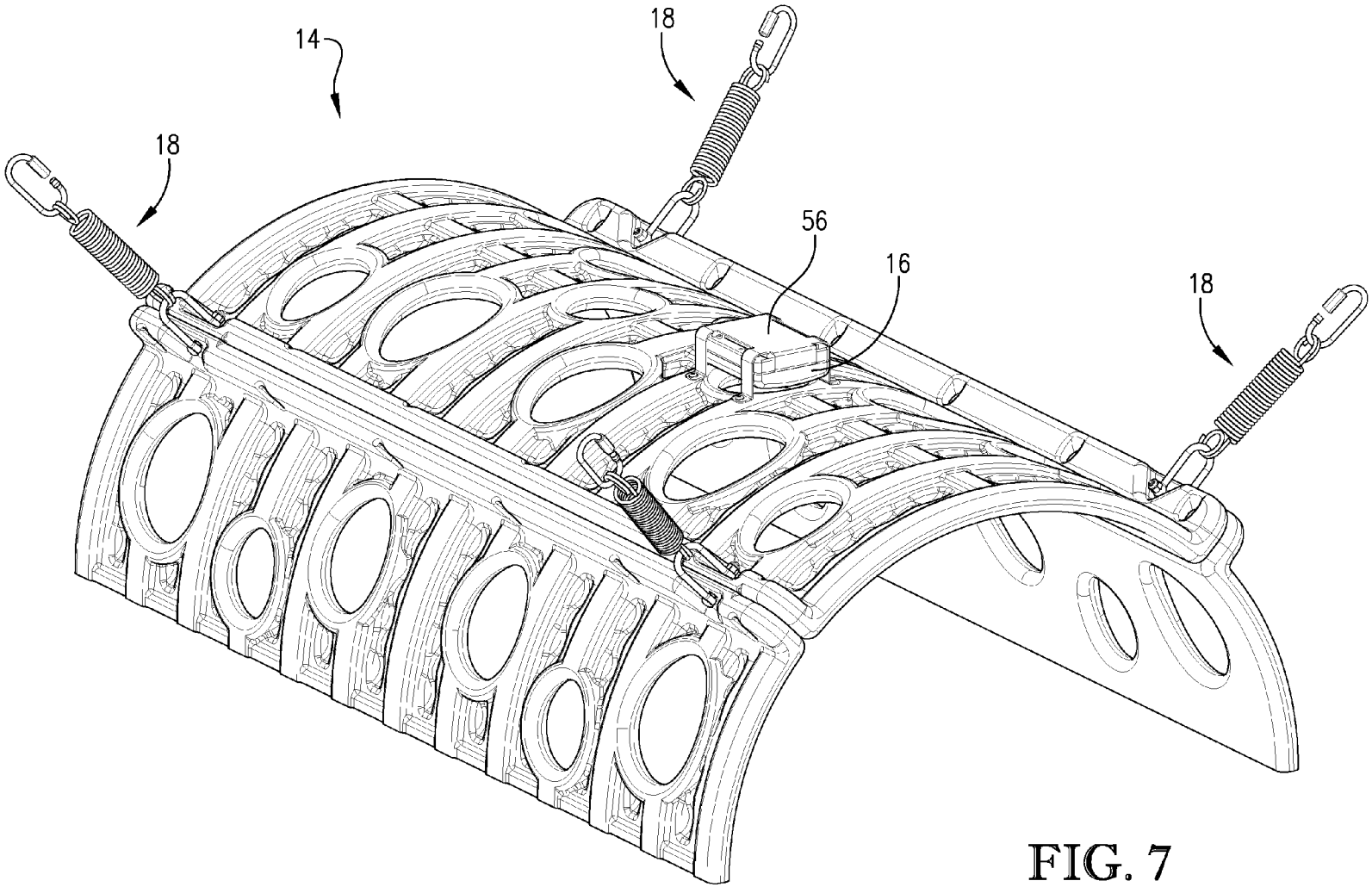
FIG. 7 is a fragmentary perspective view of the play system accessory depicting its suspension springs in more detail.

An embodiment of the tube can be of any size and shape without departing from the scope of the invention. The tube may be formed of any suitable materials such as plastic or vinyl. The interior surface of the tube is preferably smooth to allow children to easily slide through it, and the exterior surface may include a series of reinforcing ribs 20. In one embodiment, the tube is formed from a number of arcuate semi-cylindrical sections 22*a,b,c,d,*each having a pair of upstanding flanges 24*a,b,c,d* and 26*a,b,c,d*. The sections 22*a,b,c,d* are aligned end-to-end, and the adjacent flanges are bolted or otherwise attached together to form the illustrated cylindrical shape as best illustrated in FIGS. 5-7.

The tube may include a number of holes 28 through its upper portions to serve as hand holds for children while climbing through the tube. The holes 28 also allow light into the tube and permit adults to see into the tube to supervise children playing in it.

Figure 12:
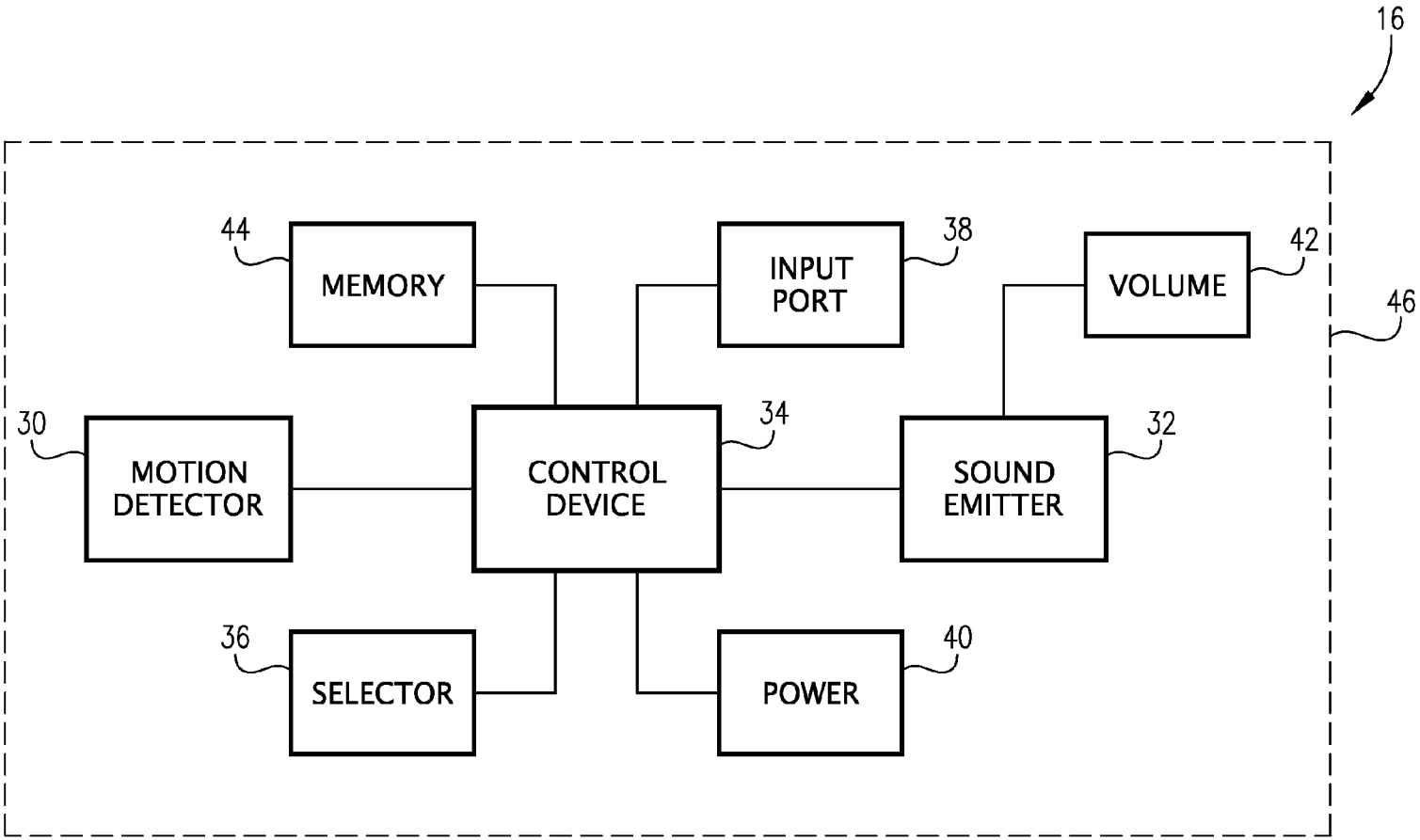
FIG. 12 is a block diagram of the primary components of the sound module of the play system accessories of FIGS. 1-11.

The sound module 16 is coupled directly or indirectly with the support 14 and is configured for producing sounds when the support moves. An embodiment of the sound module 16 is illustrated in FIG. 12 and broadly comprises a motion detector 30 for detecting motion of the support 14 and a sound-emitting device 32 for emitting sounds in response to motion of the support as detected by the motion detector. Other embodiments of the sound module 16 may also comprise a control device 34, a selector switch 36, an input port 38, and a power source 40.

The motion detector 30 may be any device or components capable of detecting movement of the support 14. For example, the motion detector may incorporate one or more ball-type switches, accelerometers, levels, gyroscopes, or strain gauges for directly detecting motion of the support. The motion detector may also include one or more ultraviolet, ultrasonic, or other wave type sensor for indirectly detecting motion of the support.

In one embodiment, the motion detector 30 comprises a ball-type switch that simply detects motion or movement of the support, not the magnitude or direction of the motion. In other embodiments, the motion detector 30 may comprise components capable of detecting the magnitude or direction of the motion. For example, an embodiment of the motion detector may comprise an accelerometer for detecting up and down motions of the support, an accelerometer for detecting left and right motions of the support, and an accelerometer for detecting forward and backward motions of the support. Upon sensing motion of the support, the motion detector generates one or more electrical signals representative of the sensed motion and either triggers the sound-emitting device or delivers the signals to the control device 34 as described below.

The sound-emitting device 32 reproduces sounds when the support 14 moves as described below and may utilize any sound reproducing technology. For example, the sound-emitting device 32 may include a speaker diaphragm that is driven by a voice coil and magnet assembly. The sound-emitting device 32 may be driven by the audio signals only or may have internal amplifiers and other driver circuitry. The sound-emitting device may also be coupled with a conventional volume control switch 42 to permit volume adjustment of the device.

The control device 34 is provided in some embodiments of the invention for receiving signals from the motion detector 30 and controlling the sounds emitted by the sound-emitting device 32 in accordance with the signals as described in more detail below. The control device 34 may include any number and type of processors, controllers, or other processing systems and may include resident or external memory 44 for storing audio files and other information accessed and/or generated by the sound module.

The control device 34 may implement one or more computer programs which control the sound-emitting device 32 as described in more detail below. The computer programs may comprise ordered listings of executable instructions for implementing logical functions in the control device. The computer programs can be embodied in any computer-readable medium for use by or in connection with the control device or any other device that can fetch and execute the instructions.

As used herein, a "computer-readable medium" can be any means that can contain, store, communicate, propagate or transport computer programs. The computer-readable medium can be, for example, but not limited to, an electronic, magnetic, optical, electro-magnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM). An embodiment of the computer-readable medium includes the memory 28.

In one embodiment, the sound-emitting device 32 emits sounds whenever the support 14 moves as detected by the motion detector 30. For example, the sound-emitting device 32 may emit a beep, a ringing sound, a tune, or a song each time the support moves. In this embodiment, the control device 34 is not needed, as the sound-emitting device 32 can be triggered directly by the motion detector 30.

In other embodiments, the control device 34 varies the sounds emitted by the sound-emitting device 32 based on a magnitude of motion or direction of motion of the support 14 as detected by the motion detector. For example, the control device 34 may instruct the sound-emitting device to emit one sound when children swing or otherwise move the support to the left, another sound when the children swing or otherwise move the support to the right, another sound when the children swing or otherwise move the support forward, another sound when the children swing or otherwise move the support backward, another sound when the children bounce or otherwise move the support upward, and yet another sound when the children bounce or otherwise move the support downward. The control device 34 may also instruct the sound-emitting device to increase the volume and/or frequencies of sounds as the support is moved rapidly and decrease the volume and/or frequencies of sounds as the support is moved more slowly. This enables children to make different sounds by swinging, bouncing, or otherwise moving the support in different directions and/or at different speeds.

The input port 38 may be provided for receiving audio signals from an MP3 player, radio, TV, computer or other external audio source for reproduction by the sound-emitting device 32. Alternatively, the sound module 16 may receive audio signals wirelessly via a Bluetooth connection or other wireless connection. In yet another embodiment, the sound module 16 may include an internal or integral MP3 player, radio, or other audio source.

The selector 36 may be any switch, button, etc. that permits a user to select an input to the control device. For example, the memory 44 may store a plurality of audio files, and the selector switch 36 may be operated by a user to select which of the audio files is reproduced by the sound-emitting device when the support is moved as detected by the motion detector.

The power source 40 may include one or more batteries, a solar cell, an electrical terminal or contact for receiving power from an electricity source, or any other conventional power supply.

The sound module 16 may also include one or more LEDs or other lights that illuminate when the motion detector detects motion of the support. Multi-colored LEDs and a selector switch may also be provided so that a user may choose the color, or colors, emitted by the LEDs. The LEDs may also be controlled by the control device so as to cycle through all of the available colors and to turn on and off to the "rhythm" of the movement of the tube as detected by the motion detector.

Figure 9:
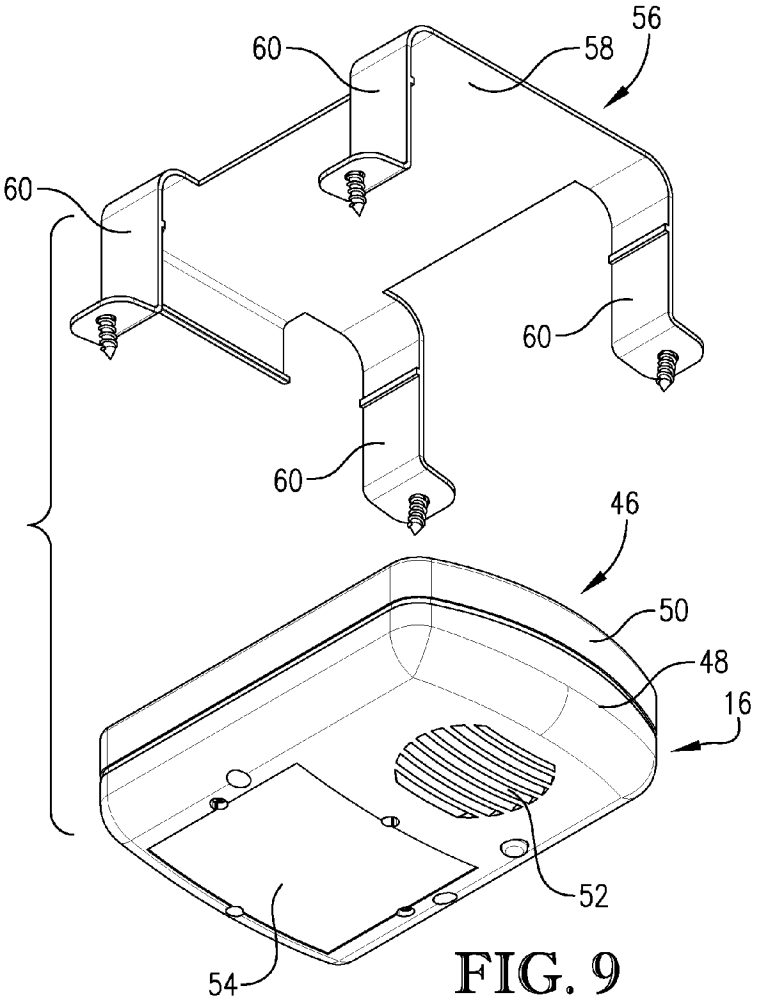
FIG. 9 is another exploded perspective view of the sound module and its mounting bracket.
Figure 8:
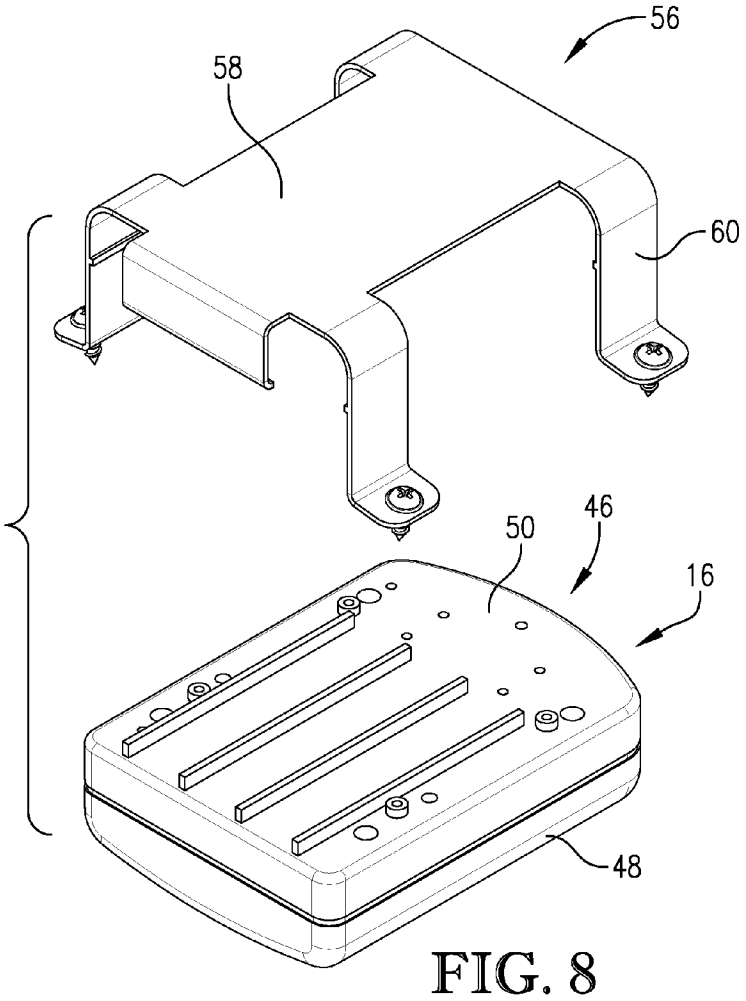
FIG. 8 is an exploded perspective view of the sound module and its mounting bracket.

The above-described components of the sound module 16 are preferably housed within a water proof or water resistant enclosure 46 made of plastic or other suitable materials. As best illustrated in FIGS. 8 and 9, the enclosure 46 may include two halves 48, 50 that can be separated to access the internal components, a slotted opening 52 for directing sounds out of the enclosure, and a battery compartment 54 for holding the batteries or other power supplies.

As best illustrated in FIGS. 5-9, the sound module 16 may be mounted near the top of the support 14 partially over one of the holes 28 so as to direct sound into the tube. The sound module may be held in place by a bracket 56 that is screwed or otherwise fastened to the tube. The bracket may be made of any suitable material such as metal and may include a planar, enclosure-engaging surface 58 and a number of generally, L-shaped legs 60 for engaging the sides of the enclosure and receiving screws or other fasteners for attaching the sound module to the tube. In embodiments where the motion detector indirectly detects motion of the support 14, the sound module may be mounted to the play system 12 rather than the support 14 so that it is indirectly coupled with the support.

Figure 10:
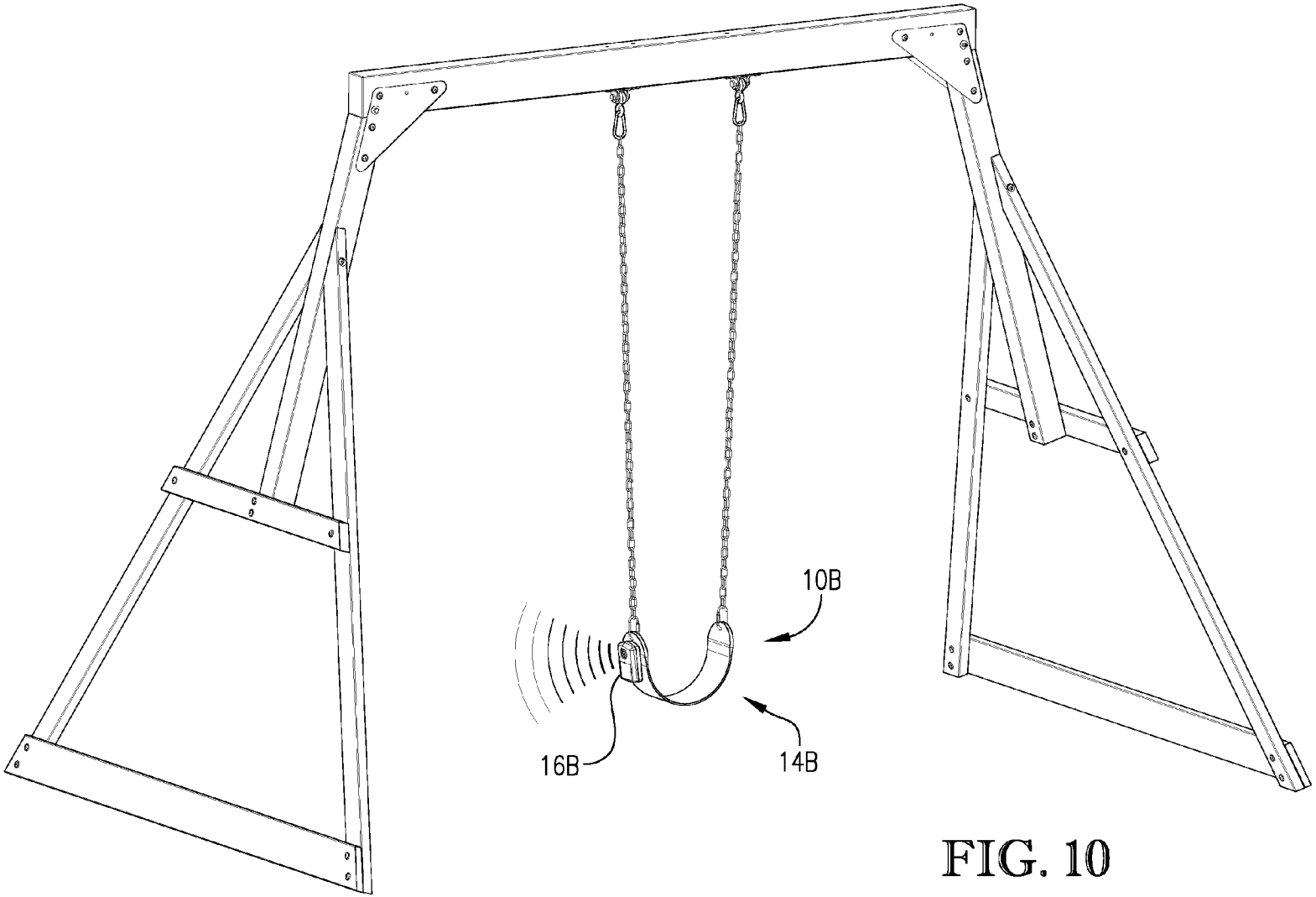
FIG. 10 is a perspective view of a play system accessory constructed in accordance with another embodiment of the invention and shown suspended from an exemplary play system.
Figure 11:
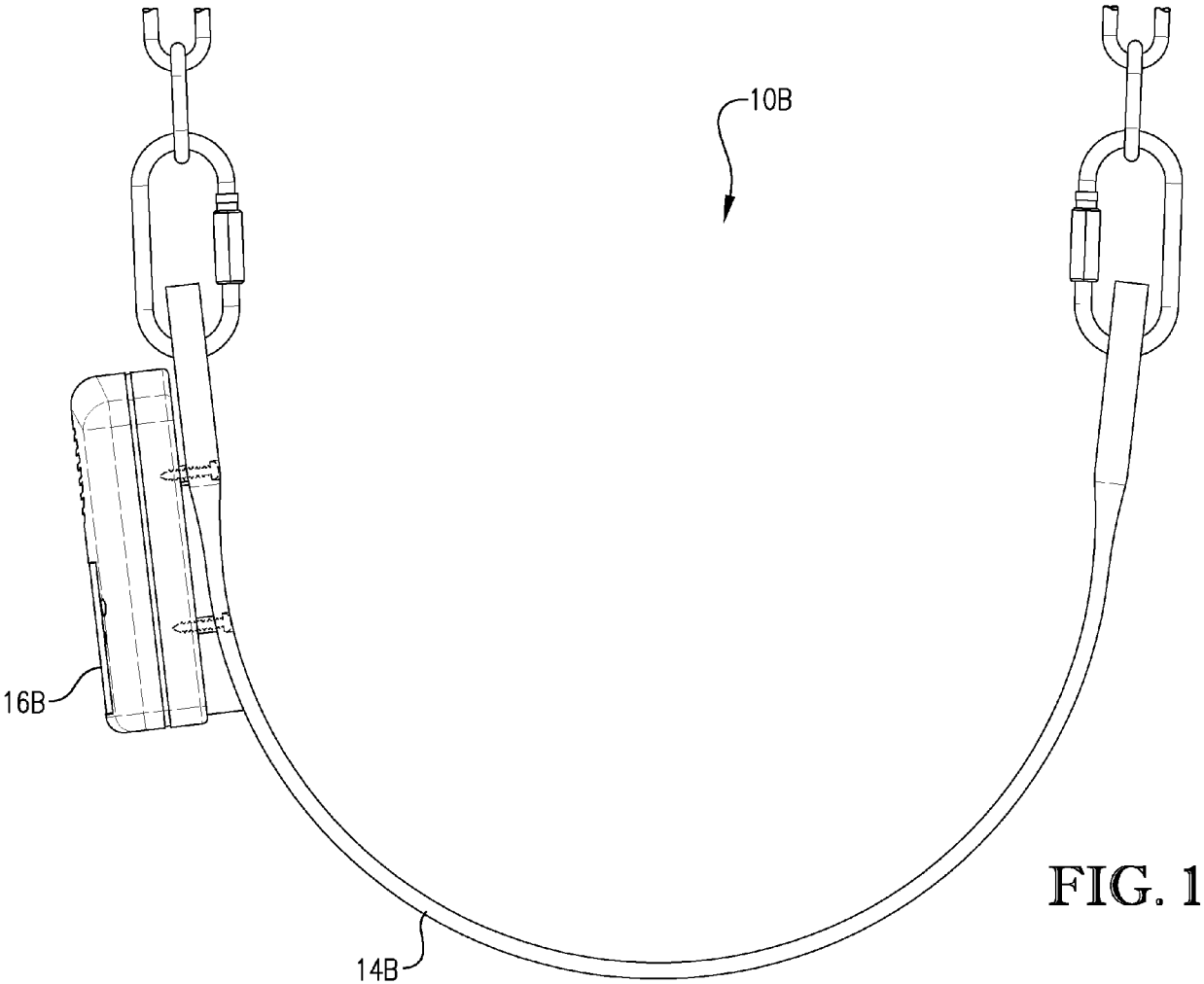
FIG. 11 is a front elevational view of the play system accessory of FIG. 10.

FIGS. 10 and 11 illustrate a play system accessory **10*b* constructed in accordance with another embodiment of the invention. The play system accessory 10*b* is similar to the play system accessory 10 of FIGS. 1-9 except that the support 14*b* is a swing seat rather than a tube or tunnel. The swing seat may be made of flexible rubber materials as illustrated or plastic, wood, metal or other rigid materials. A sound module 16*b* substantially identical to the sound module 16** described above may be affixed to the swing seat for detecting motion of the swing seat and emitting sounds. In other embodiments of the invention, the support may be a tire swing, see-saw, rope swing, etc.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. An accessory for a play system, the accessory comprising:

a support configured to be suspended from or supported on the play system; and a sound module coupled with the support and comprising:

a motion detector for detecting motion of the support; and a sound-emitting device for emitting sounds in response to motion of the support as detected by the motion detector, wherein the sound module is operable to generate a first sound in response to motion in a first direction, a second sound in response to motion in a second direction perpendicular to the first direction, a third sound in response to motion in a third direction perpendicular to the first and second directions, a fourth sound in response to motion in a fourth direction opposite the first direction, a fifth sound in response to motion in a fifth direction opposite the second direction, and a sixth sound in response to motion in a direction opposite the third direction wherein at least two of the sounds are distinct from one another.

2. The system as set forth in claim 1, wherein the support is a swing seat configured to be suspended from the play structure.

3. The system as set forth in claim 1, wherein the support is a tube or tunnel configured to be suspended from the play structure.

4. The system as set forth in claim 1, wherein the motion detector comprises a ball-type switch.

5. The system as set forth in claim 1, wherein the motion detector comprises one or more accelerometers.

6. The system as set forth in claim 1, wherein the sound module further comprises an input for receiving audio signals from an external audio source for reproduction by the sound-emitting device.

7. The system as set forth in claim 1, wherein the sound module further comprises memory for storing a plurality of audio files and a selector switch for permitting a user to select which of the audio files is reproduced by the sound-emitting device.

8. The system as set forth in claim 1, wherein the sound module is further operable to generate a seventh sound in response to a bouncing motion.

9. The system as set forth in claim 1, wherein the sound module is further operable to generate an eighth sound in response to a swinging motion.

10. The system as set forth in claim 1, wherein the sound module is further operable to modify a characteristic of the sound based on a speed at which the support is moved.

11. The system as set forth in claim 10, wherein the characteristic is selected from the group consisting of volume, frequency, duration, and quality.

12. The system as set forth in claim 1, further comprising a light module including at least one light-emitting device operable to emit lights in response to motion of the support as detected by the motion detector.

13. The system as set forth in claim 12, wherein the light module is further operable to modify a characteristic of the lights based on a speed at which the support is moved.

14. The system as set forth in claim 13, wherein the characteristic is selected from the group consisting of intensity, color, duration, and pulse.

15. The system as set forth in claim 12, wherein the at least one light-emitting device is further operable to turn on and off to a pattern of motion of the support as detected by the motion detector.

16. The accessory as set forth in claim 1, wherein the first through sixth sounds are distinct from one another.

* * * * *